US006933476B2

(12) United States Patent
Metz et al.

(10) Patent No.: US 6,933,476 B2
(45) Date of Patent: Aug. 23, 2005

(54) HEATING UNIT WITH TEMPERATURE SENSOR

(75) Inventors: Bruce E. Metz, 4802 Ferris Dr., Wilmington, DE (US) 19808; Mark S. Robinson, Churchville, PA (US)

(73) Assignee: Bruce E. Metz, Wilmington, DE (US)

( * ) Notice: Subject to any disclaimer, the term of this patent is extended or adjusted under 35 U.S.C. 154(b) by 9 days.

(21) Appl. No.: 10/691,469

(22) Filed: Oct. 21, 2003

(65) Prior Publication Data

US 2004/0149728 A1 Aug. 5, 2004

Related U.S. Application Data

(60) Provisional application No. 60/420,661, filed on Oct. 23, 2002.

(51) Int. Cl.[7] ..... H05B 1/02
(52) U.S. Cl. ..... 219/499; 219/507
(58) Field of Search ..... 219/481–499, 219/501, 505, 507; 323/235, 236, 319; 307/117; 373/1

(56) References Cited

U.S. PATENT DOCUMENTS

RE31,723 E * 11/1984 Shaw ..... 219/499
6,100,510 A 8/2000 Chen et al.

* cited by examiner

*Primary Examiner*—Tu Hoang
(74) *Attorney, Agent, or Firm*—William H. Eilberg

(57) ABSTRACT

A heating unit includes a bridge having an arm in which there is located a heating element, and a circuit for directing a sensing current through the heating element. The circuit of the present invention reduces the duty cycle of the sensing current, thus reducing the average sensing current and allowing the use of higher peak sensing currents. In one embodiment, a set of zener diodes determines the start and stop points of the sensing current pulses. In another embodiment, the start and stop points are determined by electronic logic performed by a quad comparator. In another embodiment, one of the zener diodes is replaced by a SIDAC. The invention allows sensing of heating elements having very small temperature coefficients. The circuits of the invention produce a sensing current which is relatively unaffected by variations in supply voltage.

35 Claims, 16 Drawing Sheets

SWITCHING CIRCUIT TO REDUCE SENSING CURRENT DUTY CYCLE – DELAYED START (CRC CIRCUIT)

SWITCHING CIRCUIT TO REDUCE SENSING CURRENT DUTY CYCLE – DELAYED START (CRC CIRCUIT)

SWITCHING CIRCUIT
TO REDUCE SENSING CURRENT
DUTY CYCLE – QUAD COMPARATOR
CIRCUIT

SWITCHING CIRCUIT TO REDUCE SENSING CURRENT DUTY CYCLE - ZENER DELAYED START (CRC CIRCUIT)

SWITCHING CIRCUIT TO REDUCE SENSING CURRENT DUTY CYCLE

VERSION FOR ULTRA FAST "TURN-ON" SWITCHING & IMPROVED VOLTAGE COMPENSATION

DELAYED START SENSING PULSE & LOAD WAVEFORMS -80% DESIGN VOLTAGE
-NOMINAL 200 μs PULSE WIDTH SHOWN

• SENSING PULSE BEGINS BEYOND ZERO CROSS AND ENDS AT OR BEFORE 60° AT DESIGN VOLTAGE
16.6 millisecond SAMPLING RATE FOR 60 CYCLE AC SUPPLY

HEATING UNIT WITH TEMPERATURE SENSOR

CROSS-REFERENCE TO PRIOR APPLICATION

Priority is claimed from U.S. Provisional Application Ser. No. 60/420,661, filed Oct. 23, 2002, the disclosure of which is incorporated by reference herein.

BACKGROUND OF THE INVENTION

This invention relates to the field of heating units, especially heating units intended for use in processes requiring precisely-controlled amounts of heat.

The present invention is an improvement over the circuits described in U.S. Pat. No. 6,100,510, the disclosure of which is incorporated by reference herein. The cited patent discloses a bridge circuit, in which a heating element comprises one arm of the bridge. The present invention can be used in essentially the same environment, and for the same purpose, as the circuit shown in the cited patent.

An important aspect of the invention described and claimed in U.S. Pat. No. 6,100,510 is the limitation of the sensing period duty cycle, thereby reducing unwanted heat generated by the sensing current. The circuit described in the above-cited patent samples heater resistance every 16.6 milliseconds, and is commercially useful with heater element materials having positive temperature coefficient (PTC) values as low as about 500 PPM.

The present invention has resulted in significant improvements to the original circuit described in the above-cited patent. These improvements further reduce the sensing circuit duty cycle, which reduces dissipated heat even further than in the original circuit. In turn, a short duty cycle allows the use of very high peak sensing currents, which permit the circuit to operate with heating element materials having PTC values as low as 50 PPM.

In another embodiment of the present invention, quad comparator circuitry has been devised that provides sampling rates of either 16.6 ms or 8.3 ms, and also allows the sensing period to be more precisely tailored.

In still another embodiment, switching circuitry is provided whose performance approaches that of the quad comparator circuitry, while using fewer components than are required by the quad comparator. In particular, the circuit of the present invention provides sensing pulses having an amplitude which is relatively unaffected by changes in line voltage.

SUMMARY OF THE INVENTION

The present invention provides an improvement to the heating unit described in the above-identified patent. The heating unit includes a bridge circuit, in which a heating element comprises one arm of the bridge. The circuits of the present invention make it possible not only to reduce the duty cycle of sensing current used in such units, but to control precisely the start and stop points of the sensing pulses.

In one embodiment, the circuit of the present invention uses zener diodes which cause the sensing current pulses to start and stop at desired voltages. In another embodiment, the circuit uses a quad comparator which provides the electronic logic for starting and stopping the sensing current pulses at predetermined points in a cycle.

In several of the preferred embodiments, an optocoupler is connected to a switch which generates sensing pulses, the optocoupler receiving current through an RC network that effectively speeds the current flow through the optocoupler, thereby making it practical to generate sensing pulses of very short duration. The same improvement also tends to make the circuit less dependent on supply voltage, enabling the circuit to generate sensing pulses having an amplitude which is essentially unaffected by variations in supply voltage.

Another preferred embodiment uses a SIDAC instead of one of the zener diodes. The SIDAC provides rapid turn-on of the sensing pulse, and therefore aids further in providing narrow sensing pulses, and in making the circuit less sensitive to variations in supply voltage.

The invention also includes the method of operating the control device described above. The essence of the method is the generation of sensing pulses, wherein each pulse is relatively narrow, and wherein each pulse, in general, begins substantially after the beginning of a half-cycle of the supply voltage, i.e. a substantial time following the zero crossing point. The start and stop points of the pulses are selected so as to provide sensing pulses having sufficient amplitude and duration to perform their intended function, and also so that the amplitude of the pulses is relatively unaffected by variations in supply voltage.

The method and circuit of the present invention make it practical to use sensing pulses as narrow as about 150 microseconds.

The invention therefore has the primary object of reducing the duty cycle of sensing current pulses, used in heating devices for supplying a precise amount of heat in response to a sensed temperature.

The invention has the further object of improving the efficiency of circuits described above, by reducing the amount of unwanted heat generated by the sensing current.

The invention has the further object of enabling the use of higher peak sensing currents, so as to permit operation with heating elements having very small temperature coefficients.

The invention has the further object of providing sensing pulses which can be adjusted to be either wide or narrow, and which can have leading and trailing edges which are essentially vertical, for use as described above.

The invention has the further object of providing sensing pulses as described above, wherein the amplitude of the sensing pulses is relatively unaffected by variations in supply voltage.

The reader skilled in the art will recognize other objects and advantages of the present invention, from a reading of the following brief description of the drawings, the detailed description of the invention, and the appended claims.

DETAILED DESCRIPTION OF THE INVENTION

Figure 1:
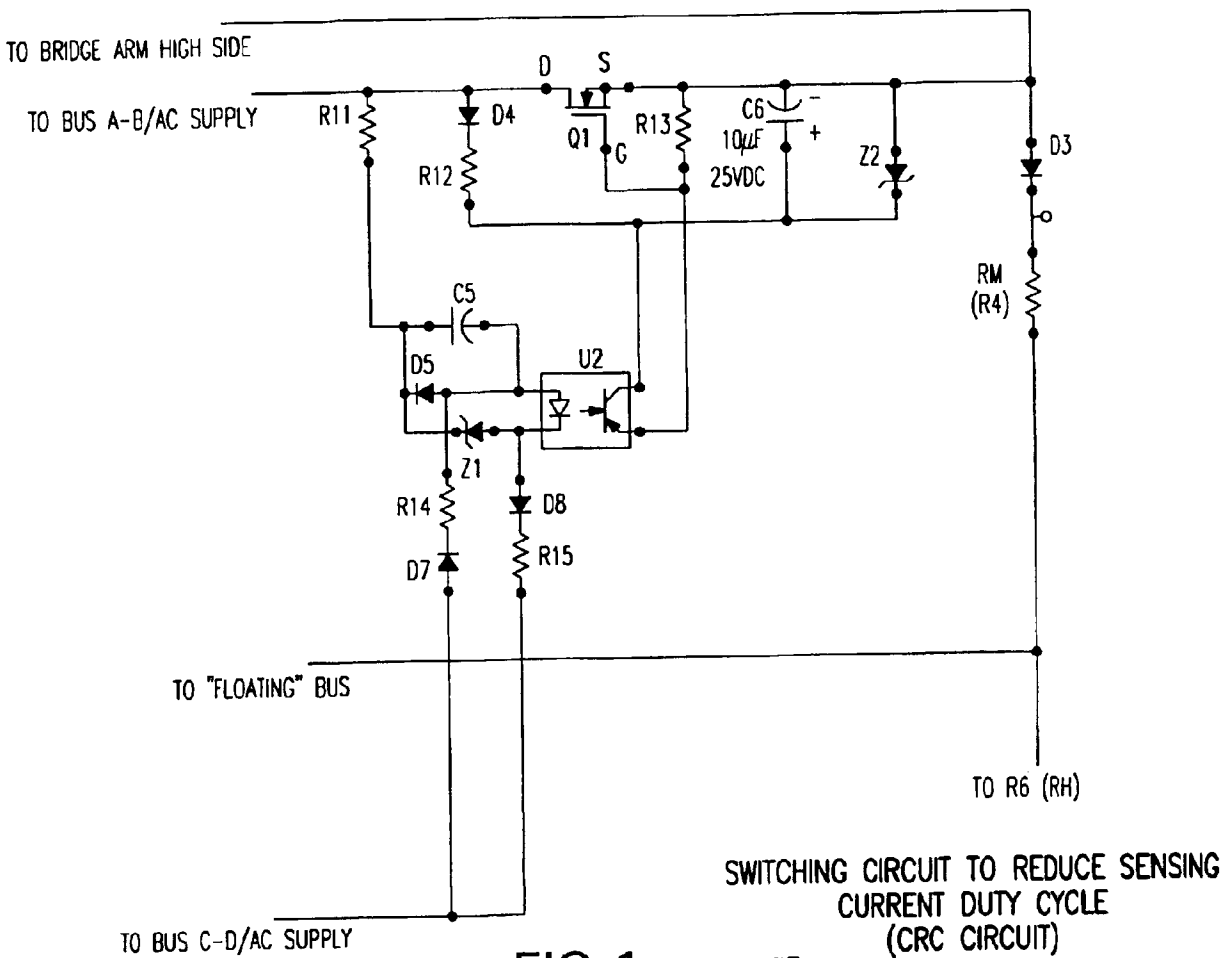
FIG. 1 PRIOR ART
FIG. 1 provides a schematic diagram of a current reduction circuit of the prior art.

In the drawings, some of the components are labeled with values and with component types. These values and component types should be considered exemplary and not limiting. Actual values, and component types, may be varied according to the needs of a particular application, as will be appreciated by those skilled in the art. For example, changing the design supply voltage is likely to require corresponding changes in one or more values of the components shown.

Figure 16:
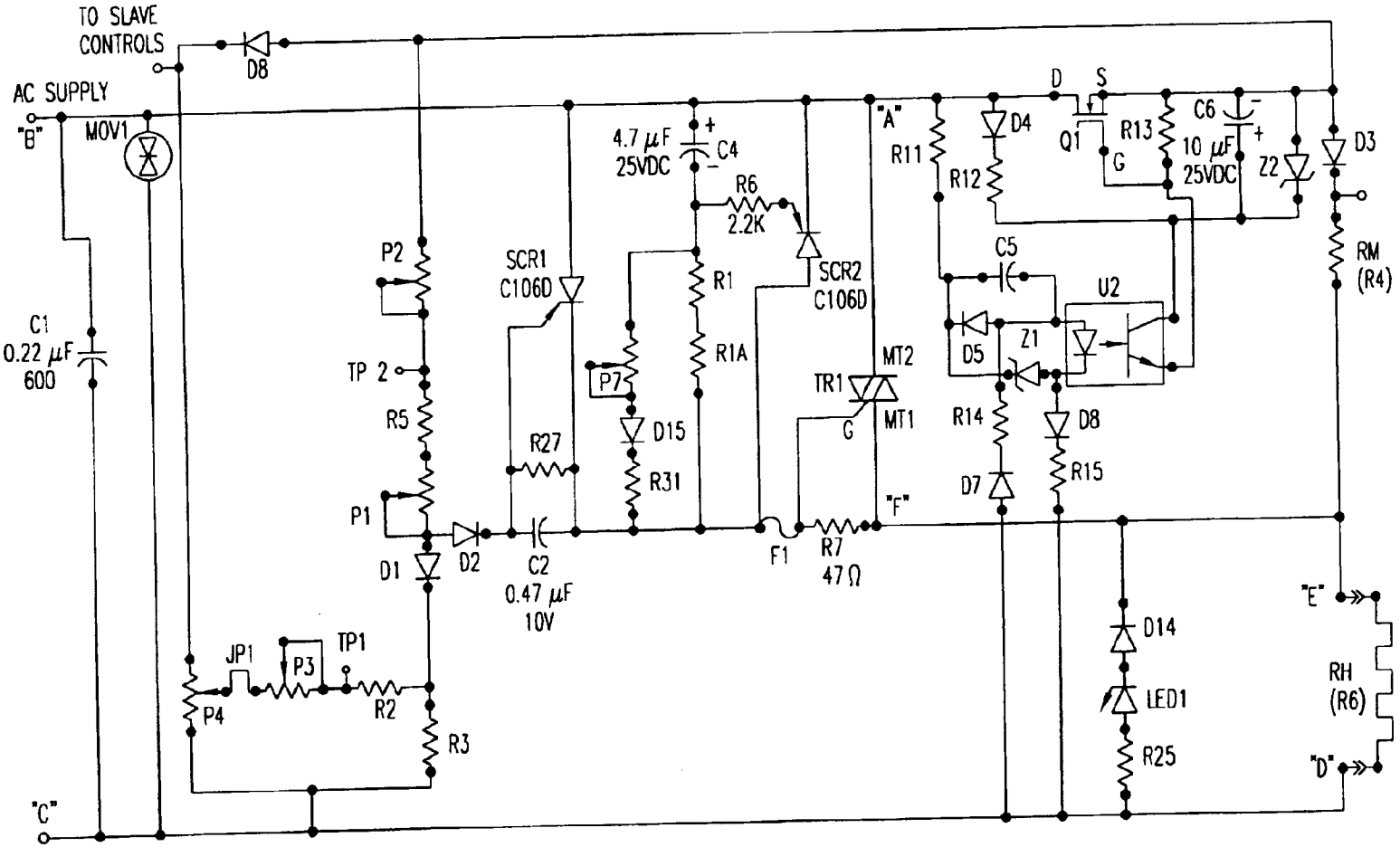
FIG. 16 PRIOR ART
FIG. 16 provides a schematic diagram of a bridge circuit of the prior art, the bridge circuit including a current reduction circuit which is the subject of the improvements described herein.

FIGS. 1 and 16 provide schematic diagrams of the original circuit covered by U.S. Pat. No. 6,100,510. The circuit of the cited patent is a bridge circuit, in which the heating element is an arm of the bridge. The ultimate object of the bridge circuit is to apply current to the heating element, so as to control precisely the temperature of that element. A further object is to do so in a manner such that the control circuitry does not itself unduly heat the heating element or the control circuit components. These objects are best satisfied when the sensing current is provided in the form of short-duration pulses. The above-cited patent therefore shows circuitry for generating such sensing pulses.

Figure 2:
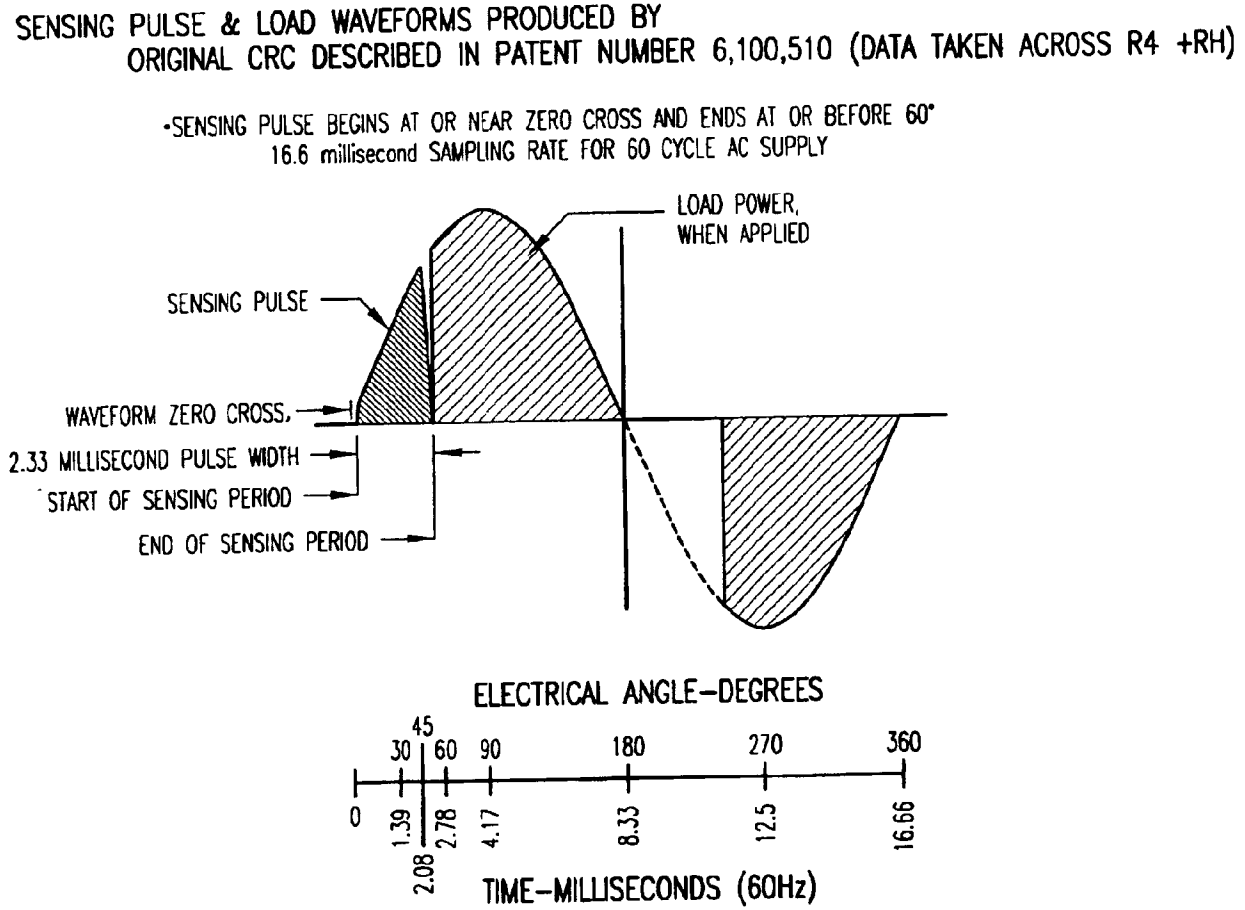
FIG. 2 PRIOR ART
FIG. 2 provides a diagram of a waveform, showing the character of the sensing period according to the prior art circuit of FIG. 1.

FIG. 16, which is similar to FIG. 2 of the above-cited patent, shows a bridge circuit, in which one arm is a heating element RH, and in which there is included a control circuit for providing narrow sensing pulses. For purposes of clarity, this control circuit is shown, in isolated form, in FIG. 1 of the present disclosure. In brief, the sensing pulses are generated by switch Q1, which in turn is controlled by optocoupler U2.

The circuit represented in FIG. 1 is known as a current reduction circuit, because an object of the circuit is to reduce the amount of sensing current in the bridge, by providing narrow pulses. The improvements of the present invention all relate to this current reduction circuit, which, in this disclosure, is also called a "CRC".

The circuit shown in FIG. 1 produces the sensing period characterized by the waveform diagram of FIG. 2. The sensing begins essentially at the beginning of each positive waveform zero cross point, and may extend into the waveform up to 60 degrees. In order for the circuit of FIG. 1 to reset, capacitor C5 must be completely discharged by energy applied to it during the waveform's opposite half cycle.

The majority of commercial heating element resistance alloys exhibit high resistivity, but generally offer positive temperature coefficient (PTC) values below 200 PPM, which is very low. The temperature coefficient, which can be defined as the change in heater resistance (in ohms) per ohm of heater resistance per degree C., is conveniently scaled by dividing by $10^{-6}$ (or, equivalently, by multiplying by $10^{6}$), so that the result can be expressed in "parts per million" (PPM).

Low PTC materials are difficult to use with known control methods that directly sense changes in heating element resistance, including that covered by the above-cited patent. Low PTC element alloys demand very high sensing current in order to generate acceptable sensing signals. This need, combined with the sensing period used by known commercial circuits, produces unacceptable amounts of heat from some circuit components. The only practical way to reduce unwanted heat is to shorten the sensing period, because any decrease in sensing current will degrade the sensing signal produced.

Figure 3:
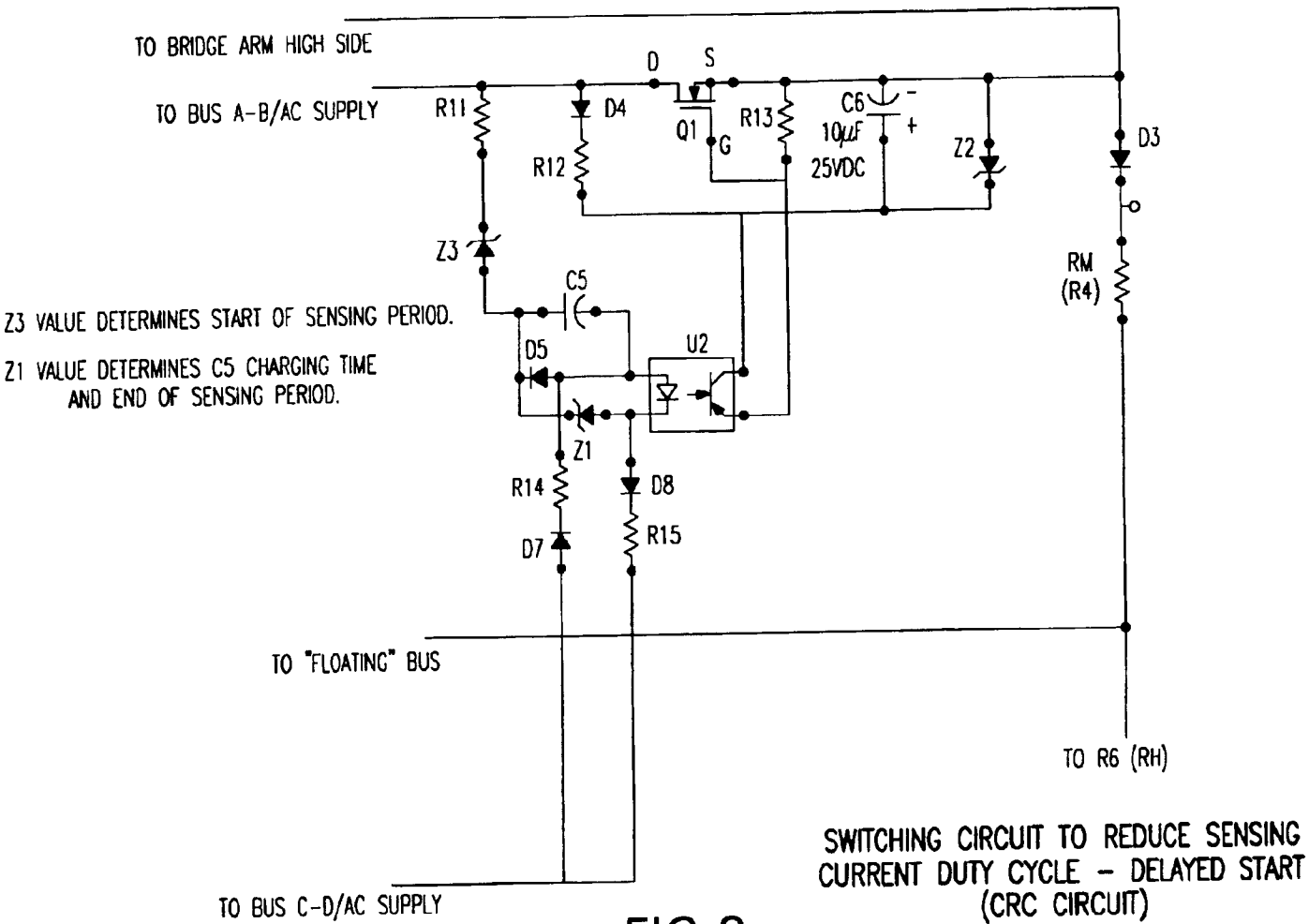
FIG. 3 provides a schematic diagram of a current reduction circuit made according to a first embodiment of the present invention, wherein zener diodes are used to control the start and stop points of the sensing period.

FIG. 3 shows one simple way to accomplish sensing periods shorter than those described in U.S. Pat. No. 6,100,510. A zener diode Z3 is inserted in one power supply leg feeding the CRC. Zener diode Z3 is inserted downstream from R11. Zener diode Z3 prevents the CRC from becoming active until the supply waveform reaches zener voltage. The effect is shown in the waveform diagram of FIG. 4. The sensing period is now forced to begin long after the zero crossing point of the waveform. A shortened duty cycle is produced when the zener voltage of Z1 is adjusted downward to limit the charging time allowed C5. Thus, Z3 controls the turn-on point, and Z1 controls the turn-off point, so that the these components respectively control the start and stop points of the sensing pulses.

Shortening the duty cycle allows peak sensing current to be substantially increased so that the control circuit can be used with some low PTC alloys. The method is both economical and effective for many commercial applications. The method has been found to have some performance limitations imposed by component availability and tolerance issues, but is still quite useful.

Figure 5:
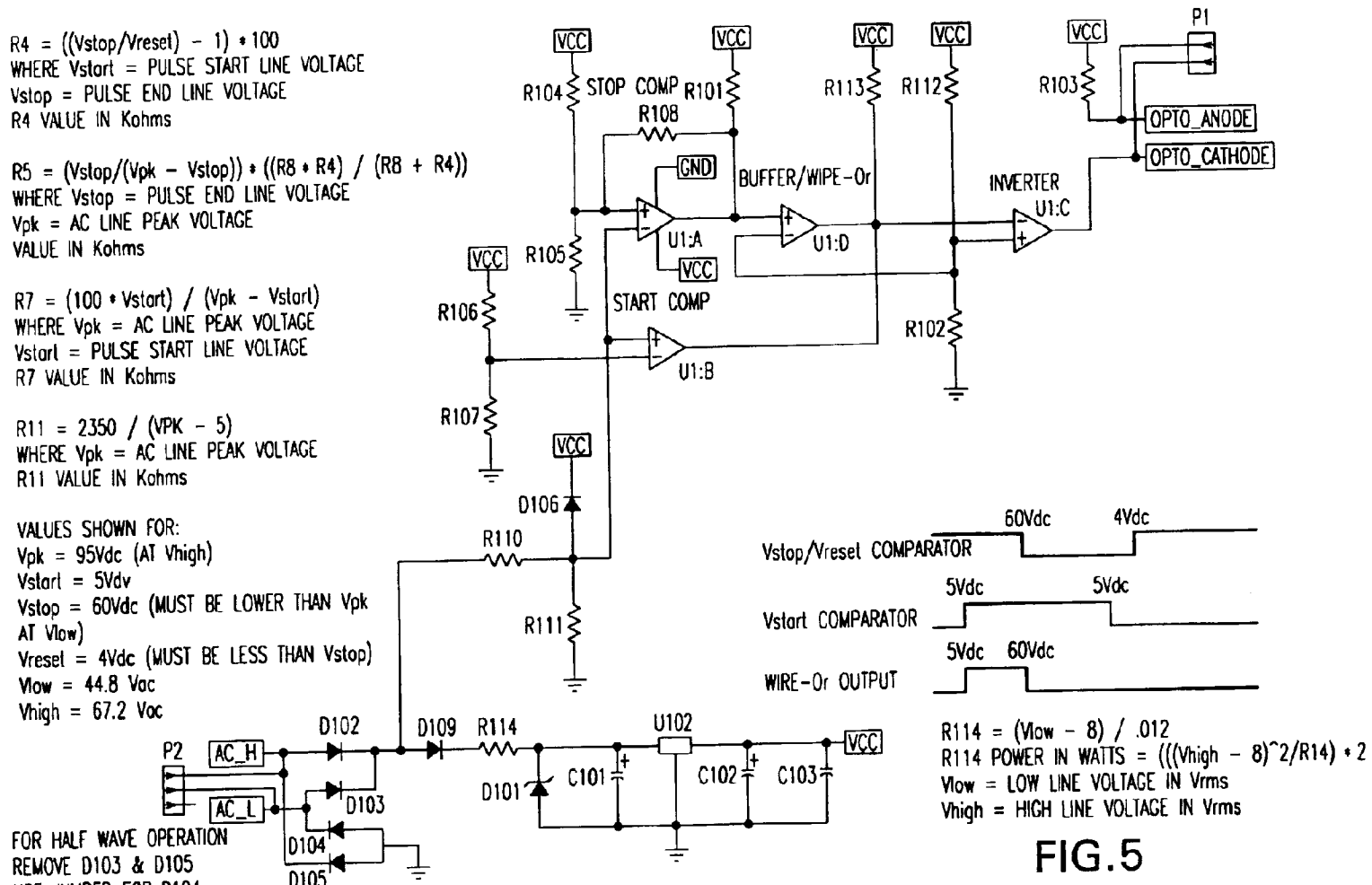
FIG. 5 provides a schematic diagram of a circuit made according to an alternative embodiment of the present invention, wherein a quad comparator is used to control the start and stop points of the sensing period. The figure also includes pulse diagrams which illustrate the voltages at the various comparators.
Figure 6:
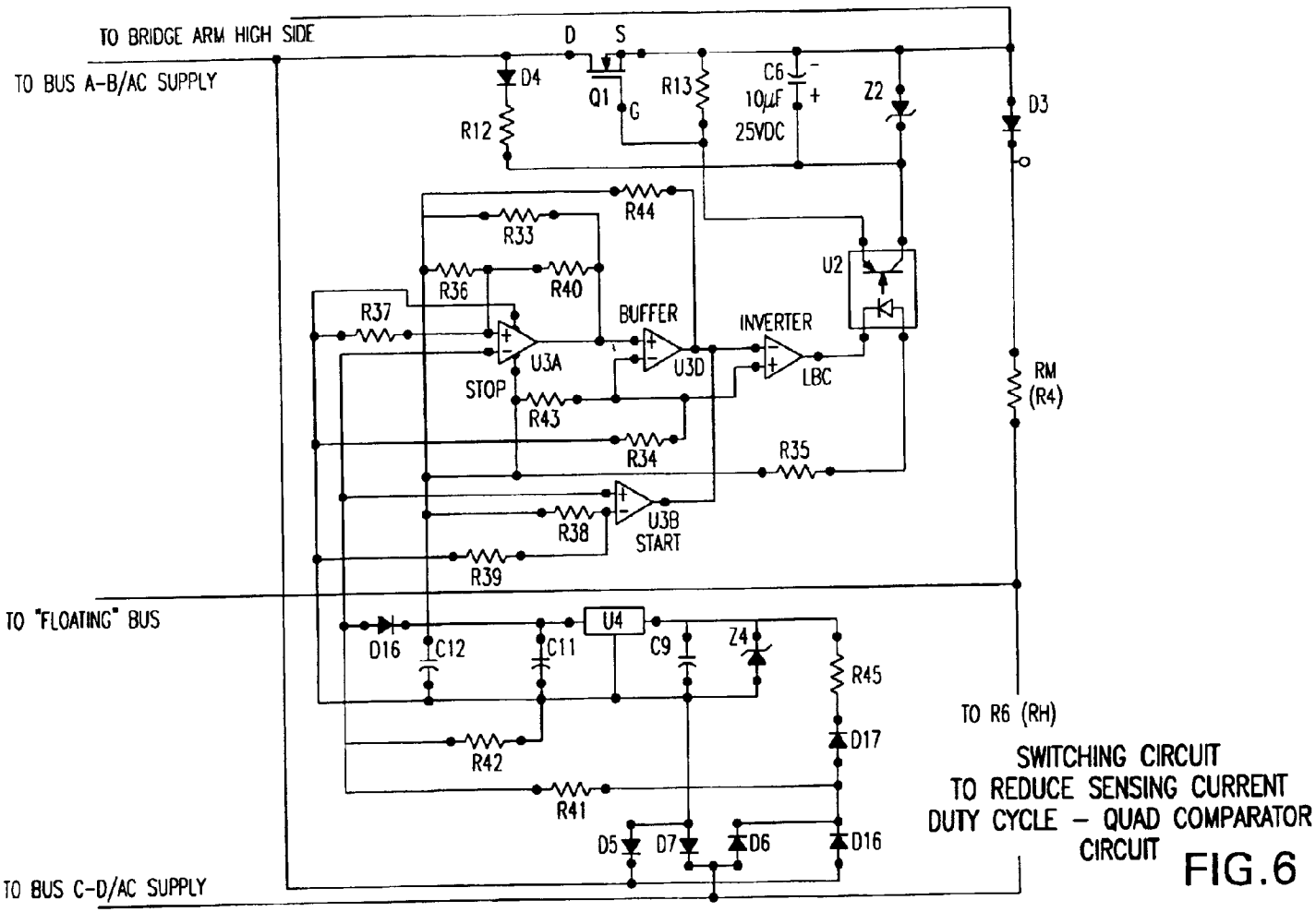
FIG. 6 provides a schematic diagram, showing the integration of the circuit of FIG. 5 into a circuit for controlling a heating unit.

A more sophisticated approach is shown in FIGS. 5 and 6. FIG. 5 is a pulser schematic and FIG. 6 is very similar to FIG. 5, but it also shows the integration of the circuit into the control circuitry of U.S. Pat. No. 6,100,510. This circuitry is voltage-based. A quad comparator is used to generate signal pulses that operate the optocoupler U2, which, in turn, switches Q1, which is the switch that provides sensing current to the heating element. The comparator-based pulser circuit allows precise tailoring of sensing period characteristics over a wide range. That is, with the circuit of FIGS. 5 and 6, one can precisely control the point at which one starts the sensing current pulse, and the point at which the sensing current pulse is terminated. The circuit of the present invention can be used to create a sensing pulse having any desired width. Moreover, the latter can be achieved for a wide variety of power supply voltages.

Unlike the embodiment of FIG. 3, the embodiment of FIGS. 5 and 6 does not use zener diodes to control the point at which the sensing period begins and ends. Instead, the embodiment of FIGS. 5 and 6 uses a quad comparator, which is substituted for the circuit comprising R11, Z3, C5, D5, Z1, R14, D7, and D8 of FIG. 3. The quad comparator accurately generates a signal that causes U2 to trigger Q1 as desired.

The quad comparator pulse generator produces a programmable and stable sensing pulse based on three absolute AC line voltage trip points. These trip points may be parametrically adjusted by changing a group of resistor values. The trip points are chosen to provide an optimum heater temperature sensing current.

The operation of the circuit will be described below, with reference to the schematic diagram of FIG. 5. The input AC line voltage is full wave rectified by diodes D102–D105. The resulting waveform is amplitude scaled by R110 and R111 such that the peak AC line voltage is reduced to +5 VDC at the input to comparators U1A and U1B. This is used as the reference for the start and stop comparators. The full wave rectified AC is also used to produce a regulated 5 VDC logic supply that operates the circuitry. The power supply comprises D109, R114, D101, C101, U102, C102, and C103.

The start comparator (U1B), produces a pulse that rises on the rising portion of the AC line waveform and falls on the falling portion of the AC line waveform when the AC line voltage reaches the start trigger voltage. The positive going edge of this pulse corresponds to the start of the sensing period. Resistors R106 and R107 set the reference point for this comparison against the scaled AC input. The stop comparator (U1A) has two voltage trip points. These two points are independently adjustable due to the use of hysteresis in the comparator circuit. The first output edge of the comparator is falling edge triggered at the rising portion of the AC line waveform trip point. This represents the end of the sensing period and must be set higher in value than the start trip point for proper circuit operation. The second trip point is set to lock out the circuit from false triggering on falling portion of the rectified AC line waveform. This trip point must be set to a lower voltage than the start trip point.

A third comparator (U1D) is used as a buffer for the stop comparator (for circuit isolation) and also provides a logical OR function. The start and stop pulses described earlier are combined in a logical OR operation. The resulting pulse edge rises at the start trip point and falls at the stop trip point.

Finally, a fourth comparator inverts the logic of this sensing pulse and drives the LED in the opto-isolator used for producing the actual sensing pulse.

When a full wave input bridge is used, the pulse is generated on each half cycle of the AC line voltage waveform. If a half wave bridge is used (by removing D103 and D105, and replacing D104 by a jumper), the pulse will only occur once each AC line voltage cycle. This allows both 1× and 2× line frequency sensing pulses. The two trip points do not change as the AC line voltage is varied as long as the peak AC line voltage is greater than the stop trip point. This stabilizes the temperature controller against shifts in set point due to line voltage variations.

The circuit of the present invention is also highly tolerant of variations in supply voltage and does not require exposure to a reverse polarity half wave to reset. These attributes not only allow minimal sensing periods, but also make it possible to construct a control that has an 8.3 ms sampling rate.

Figure 4:
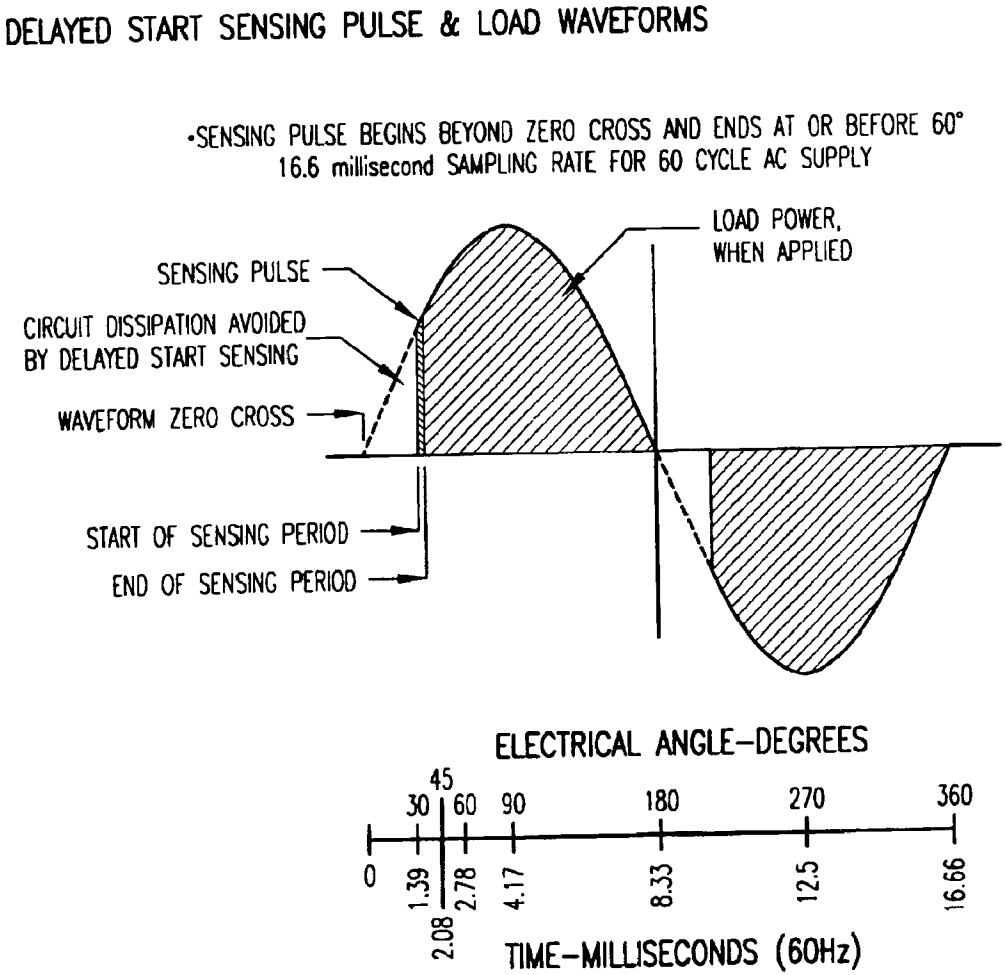
FIG. 4 provides a diagram of a waveform, illustrating the control of sensing period according to the circuit of FIG. 3.
Figure 7:
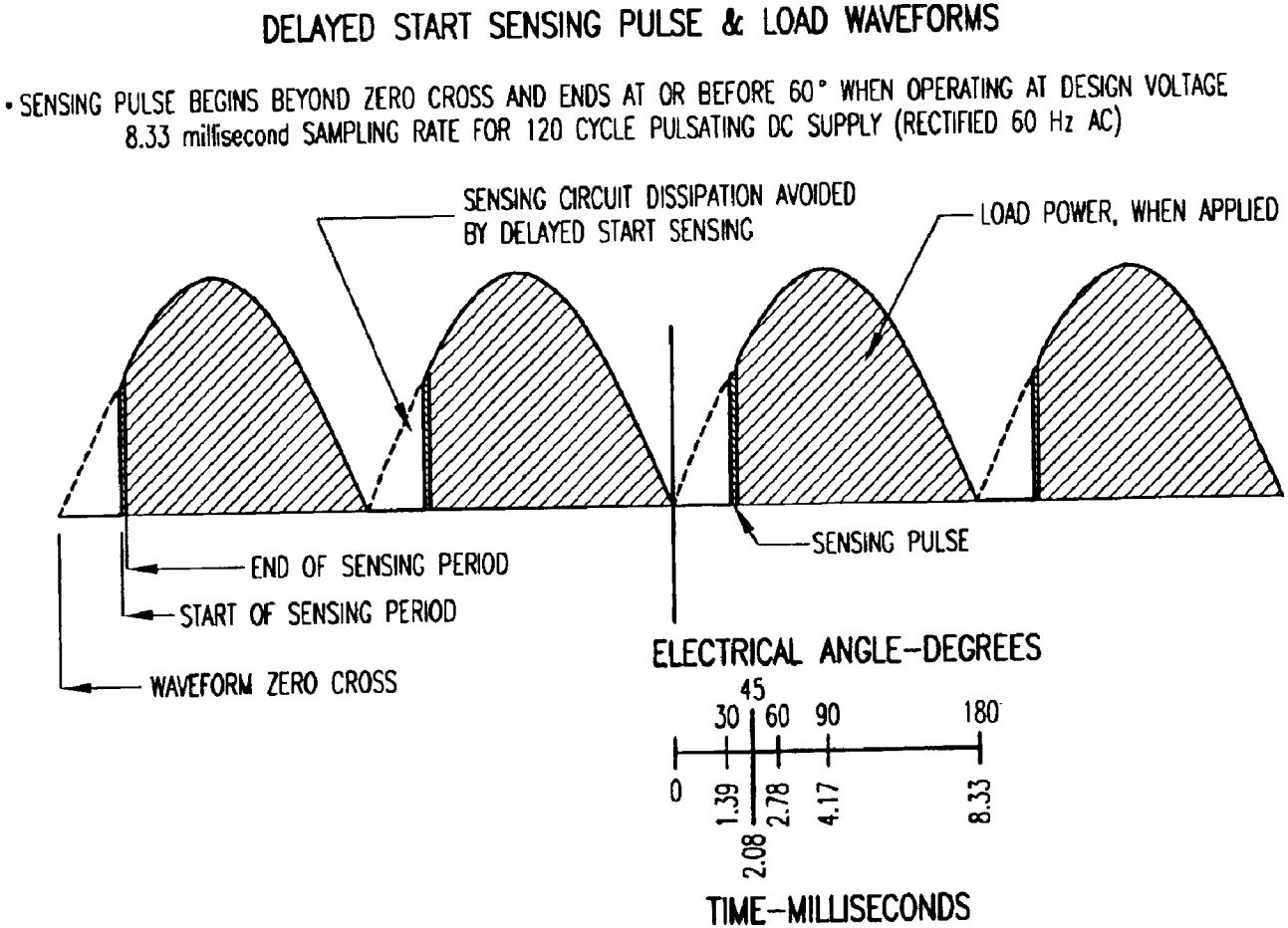
FIG. 7 provides a diagram of a waveform, illustrating the control of the sensing period according to the circuits of FIGS. 5 and 6.

Control output waveforms for a 16.6 ms sampling rate are shown in FIG. 4. FIG. 7 displays control output waveforms for the 8.3 ms sampling rate. In the embodiment having an 8.3 ms sampling rate, the control must be supplied with pulsating DC from a full wave bridge rectifier of adequate ampacity to drive both the control and its heating load.

Figure 8:
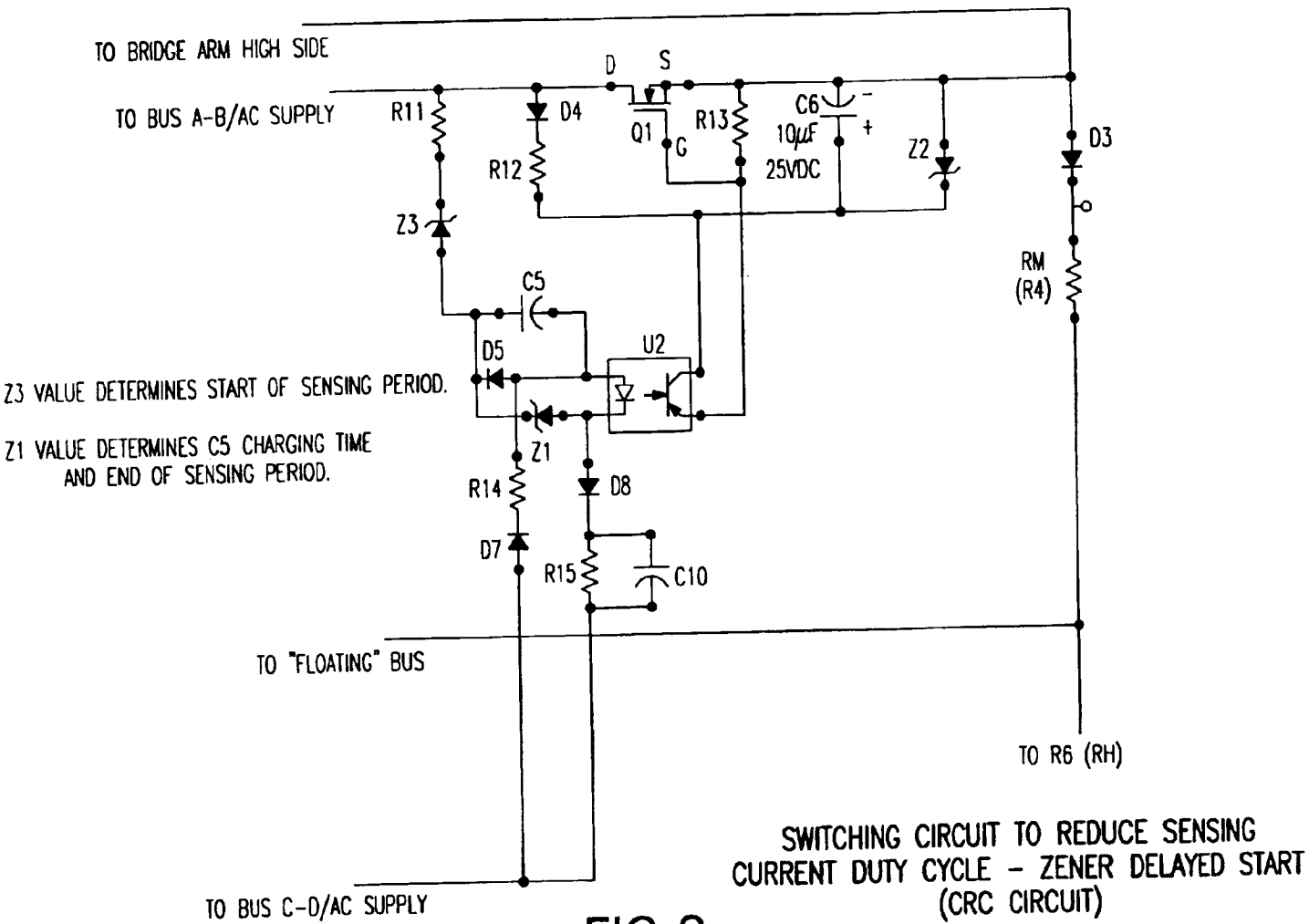
FIG. 8 provides a schematic diagram of a current reduction circuit made according to another alternative embodiment of the invention, this embodiment using zener diodes to control the start and stop points of the sensing period.

FIG. 8 provides a schematic diagram of an alternative and further improved embodiment of the CRC of the present invention. This embodiment is an improvement on FIG. 3. While the quad comparator circuitry of FIGS. 5 and 6 performs very well, it has the disadvantage that it requires a larger number of components. The aim of the circuit of FIG. 8 is to improve the circuit of FIG. 3, while still limiting the number of required components.

The circuit of FIG. 8 makes it still easier to generate narrow sensing pulses, and further enhances the ability of the current reduction circuit to generate sensing pulses that are relatively unaffected by changes in supply voltage.

The difference between the embodiment of FIG. 8 and that of FIG. 3 is in the addition of capacitor C10, connected across R15. At high AC frequencies, capacitor C10 becomes essentially a short-circuit for alternating current, and therefore allows optocoupler U2 to reach a full-current state very quickly. This feature, in turn, means that switch Q1, which provides sensing current to the heating element, is turned on more quickly. Thus, the leading edge of the sensing pulse becomes nearly vertical. That is why the addition of capacitor C10 assists in generating narrow pulses with a near vertical leading edge.

Capacitor C10 also helps to make the turn-on point of the sensing pulse more voltage dependent than time dependent. As explained above, the zener diodes Z3 and Z1 determine the turn-on and turn-off points of the sensing pulse. By making the circuit more responsive, capacitor C10 tends to insure that the circuit will generate a sensing pulse almost immediately upon the firing of Z3. That is, the circuit will generate a sensing pulse based on the instantaneous value of the supply voltage, and not based on time since zero crossing.

Note that without C10, one would need too small a value for R11 to generate pulses having a faster rise time. In general, the larger the resistance of R11, the more slowly the pulse reaches its full amplitude.

Also, capacitor C10 operates in concert with capacitor C5 and resistor R11 to form a voltage divider network that provides performance superior to that obtained from the RC network of the previous CRC. More specifically, this RC network controls the slope of the leading edge of the sensing pulse. Without R11, the slope of the leading edge would be nearly vertical. The profile of the trailing edge of the pulse is determined partly by Z1, which controls the start of the turn-off, partly by the combination of R13 and the gate capacitance of Q1, and partly by the response time of U2.

Figure 9:
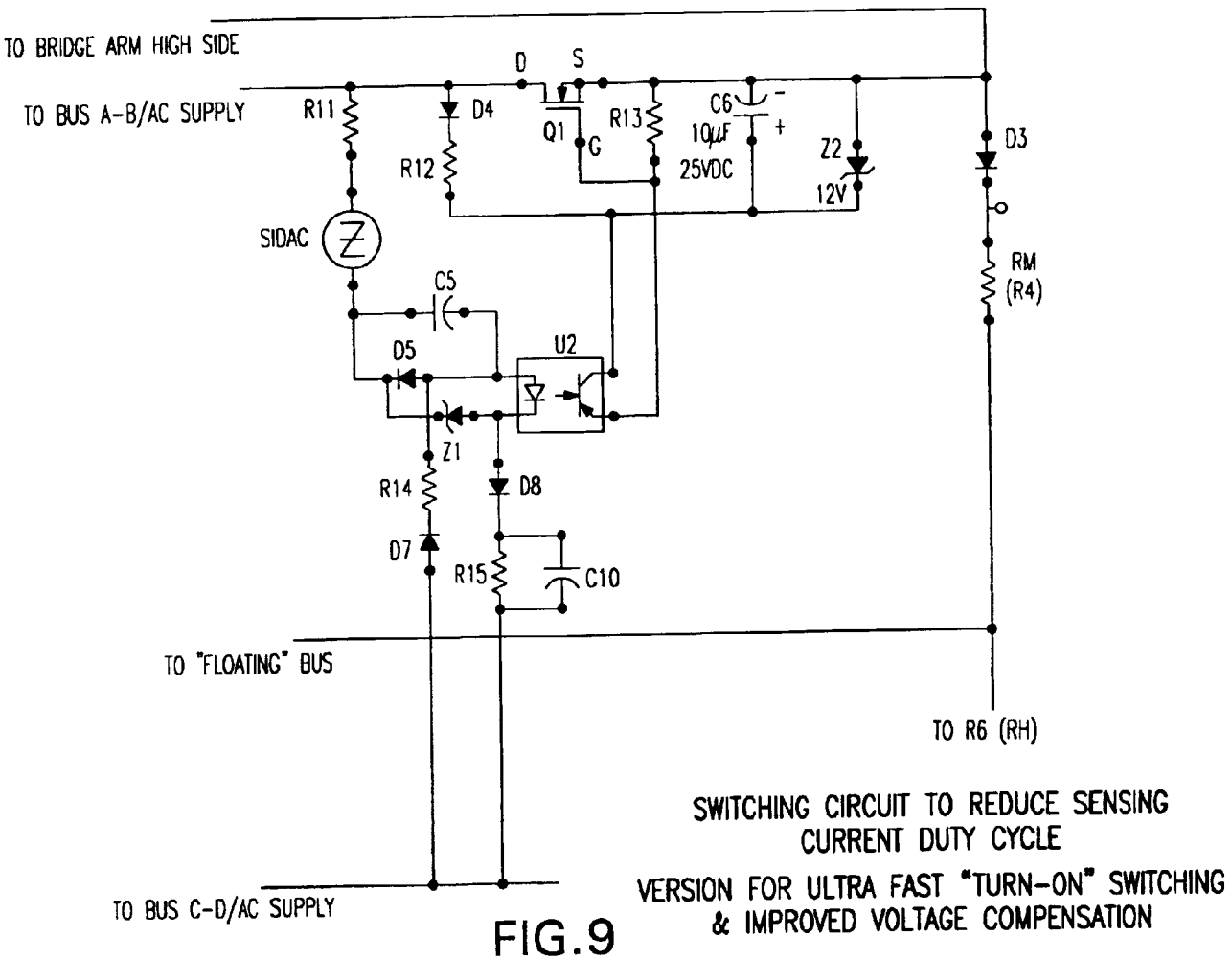
FIG. 9 provides a schematic diagram of a current reduction circuit made according to another alternative embodiment of the invention, wherein one of the zener diodes is replaced with a SIDAC.
Figure 10:
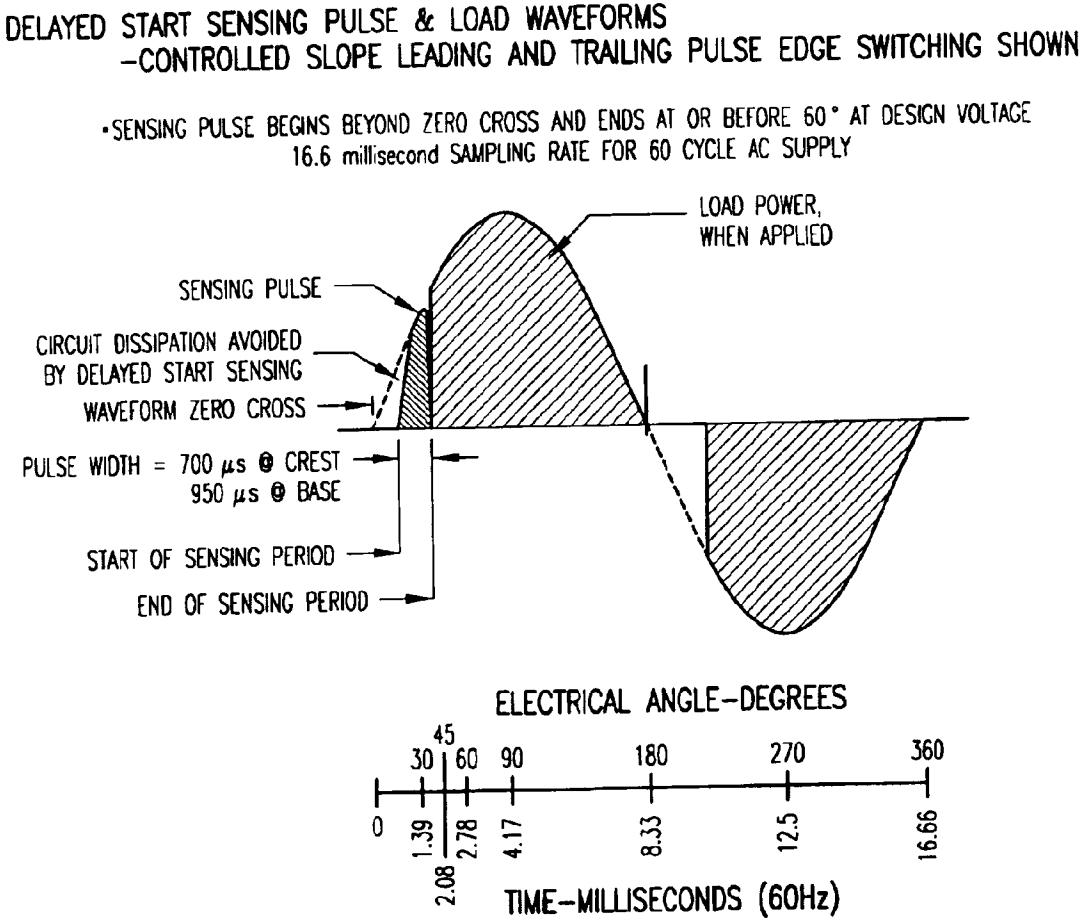
FIG. 10 provides a waveform diagram, illustrating the shape of a typical sensing pulse produced by a current reduction circuit controlled by a zener diode, according to the present invention.

FIG. 9 shows another improvement, wherein the zener diode Z3 is replaced by a silicon bilateral voltage triggered switch known as a SIDAC. The term SIDAC is a known term in the art, and is an acronym for "Silicon Diode for Alternating Current". A SIDAC is similar to a thyristor, but does not have a gate. Instead, when the SIDAC reaches a "breakover" voltage, its internal resistance becomes very low, and the voltage drop across the device becomes very small. The SIDAC is more of a switch than a zener diode; after reaching breakover voltage, the SIDAC becomes essentially a short-circuit, with a constant, low resistance, and stays in this condition until its main terminal current is interrupted, or until the current drops below a holding value.

The SIDAC is especially useful in the CRC because it changes state very quickly, and produces very fast turn-on of switch Q1. The SIDAC thus helps to minimize switching losses in Q1, and thus reduces unwanted generation of heat. When a SIDAC is used, and when capacitor C10 is installed across R15, as shown in FIG. 9, the performance of the circuit approaches that obtained from the quad comparator pulser circuit of FIG. 5, but with fewer components.

The improved CRC can shorten the duration of the sensing pulse, making it practical to use sensing pulses as short as about 100 microseconds. This feature results from the fact that the circuit is sufficiently responsive to make the leading and trailing edges of the sensing pulses essentially vertical.

All of the versions of the CRC of the present invention provide excellent compensation for variations in supply voltage. This feature is illustrated by the graph of FIG. 11, and by the waveform diagrams of FIGS. 12–15, discussed below.

If one desires to have a sensing pulse of a desired amplitude, it is necessary that the sensing pulse be generated according to the instantaneous value of the supply voltage, and not according to time. That is, if the sensing pulse were always made to start, say, two milliseconds after the zero crossing point, the amplitude of the sensing pulse would change with variations in the supply voltage. To maintain the amplitude of the sensing pulses, it is necessary to make such pulses voltage-dependent rather than time-dependent.

The CRC of the present invention accomplishes the above object. In essence, the delay angle, i.e. the time following the zero crossing point before which the sensing pulse begins, is varied so as to maintain pulses of essentially constant amplitude. The change in delay angle is determined inherently by the set points of the zener diodes and/or the SIDAC. If the zener diode Z3, or the SIDAC, is set to conduct at a particular voltage, the sensing pulse will not be generated until that voltage is reached. Thus, the onset of the sensing pulse is determined by the firing voltage of the zener diode (or the breakover voltage of the SIDAC), and not by any pre-set time interval.

Figure 11:
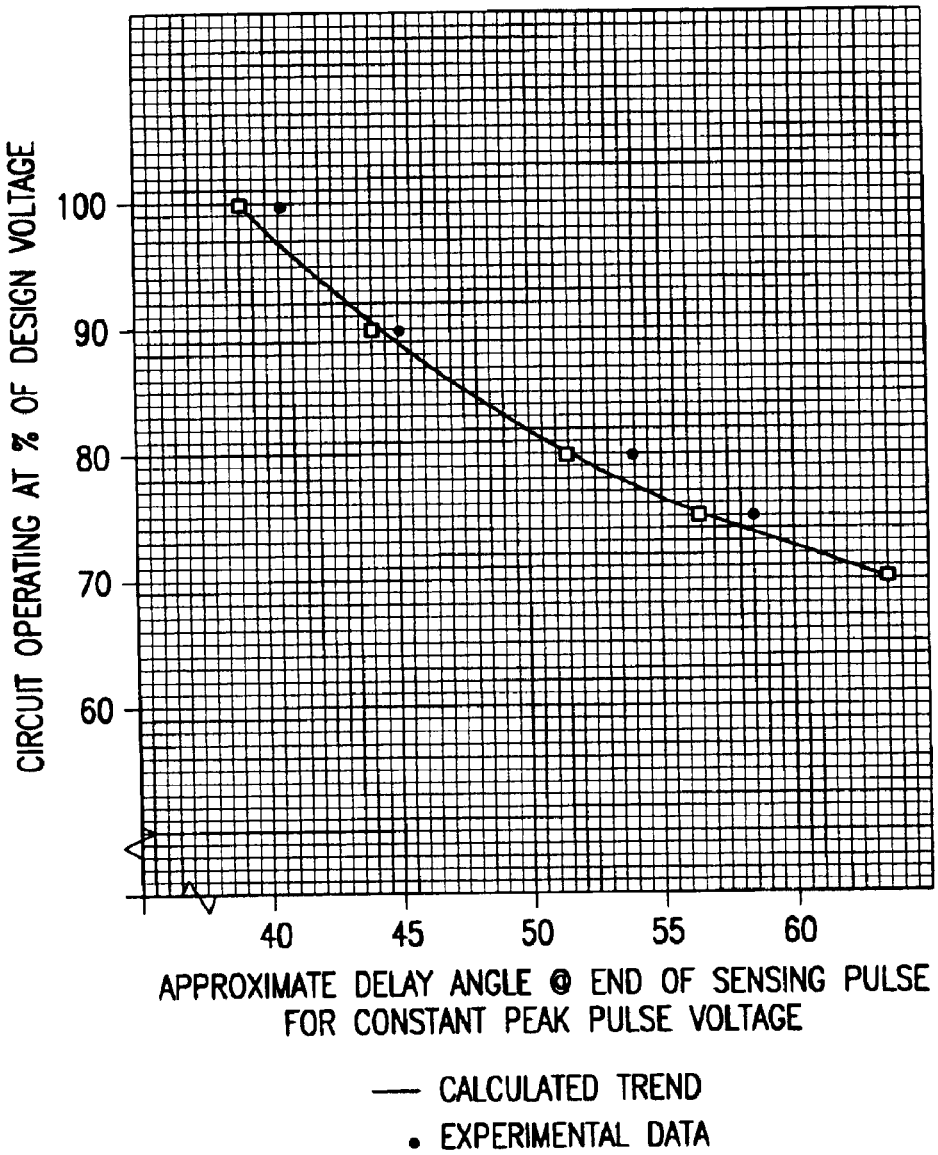
FIG. 11 provides a graph showing changes in the delay angle of the start of the sensing pulse, for different values of supply voltage, obtained from the current reduction circuit of the present invention.
Figure 12:
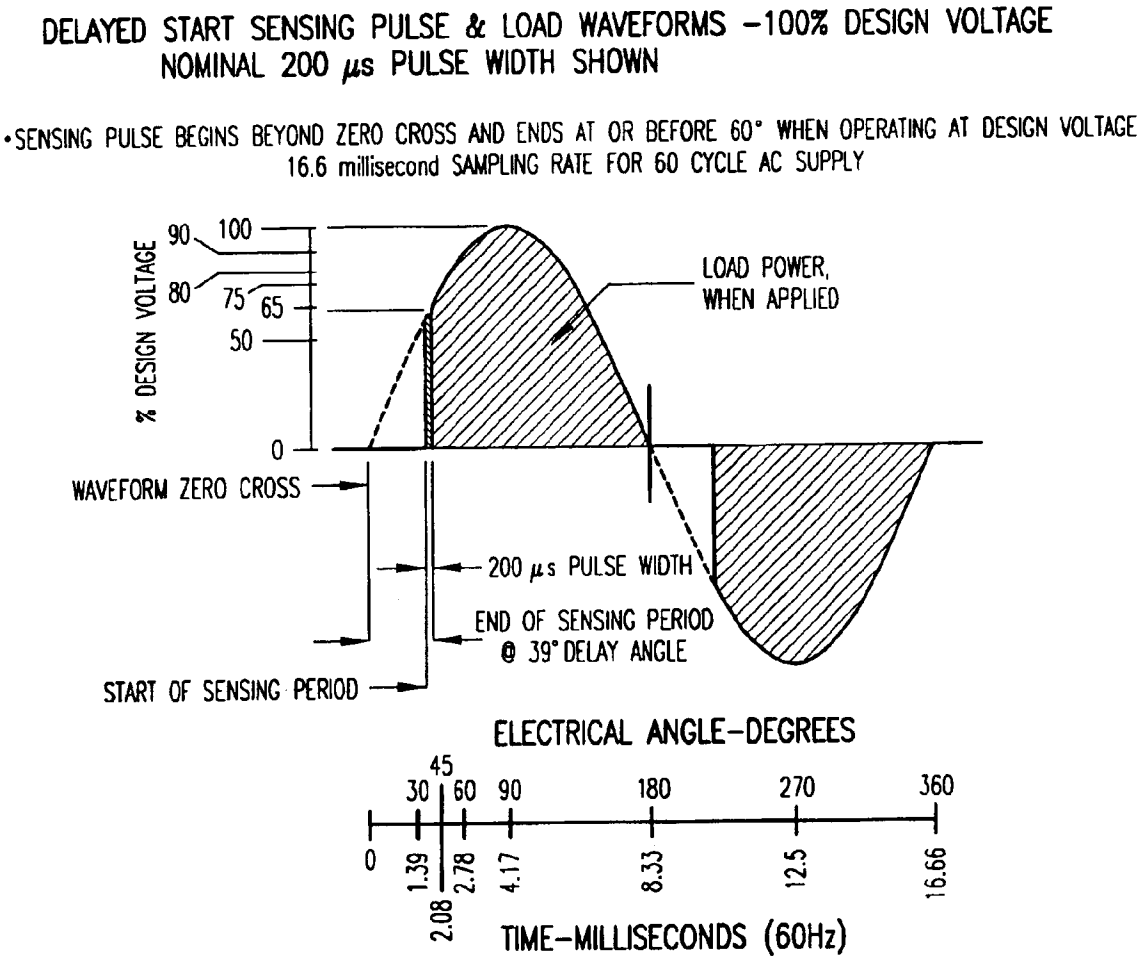
FIGS. 12–15 provide waveform diagrams showing the sensing pulses produced by the circuit of the present invention, for different values of supply voltage, the diagrams showing that the amplitude of the sensing pulse is relatively unaffected by changes in supply voltage. Each of these figures also includes a timing diagram, showing the electrical angle associated with various critical points on the basic waveform.
Figure 13:
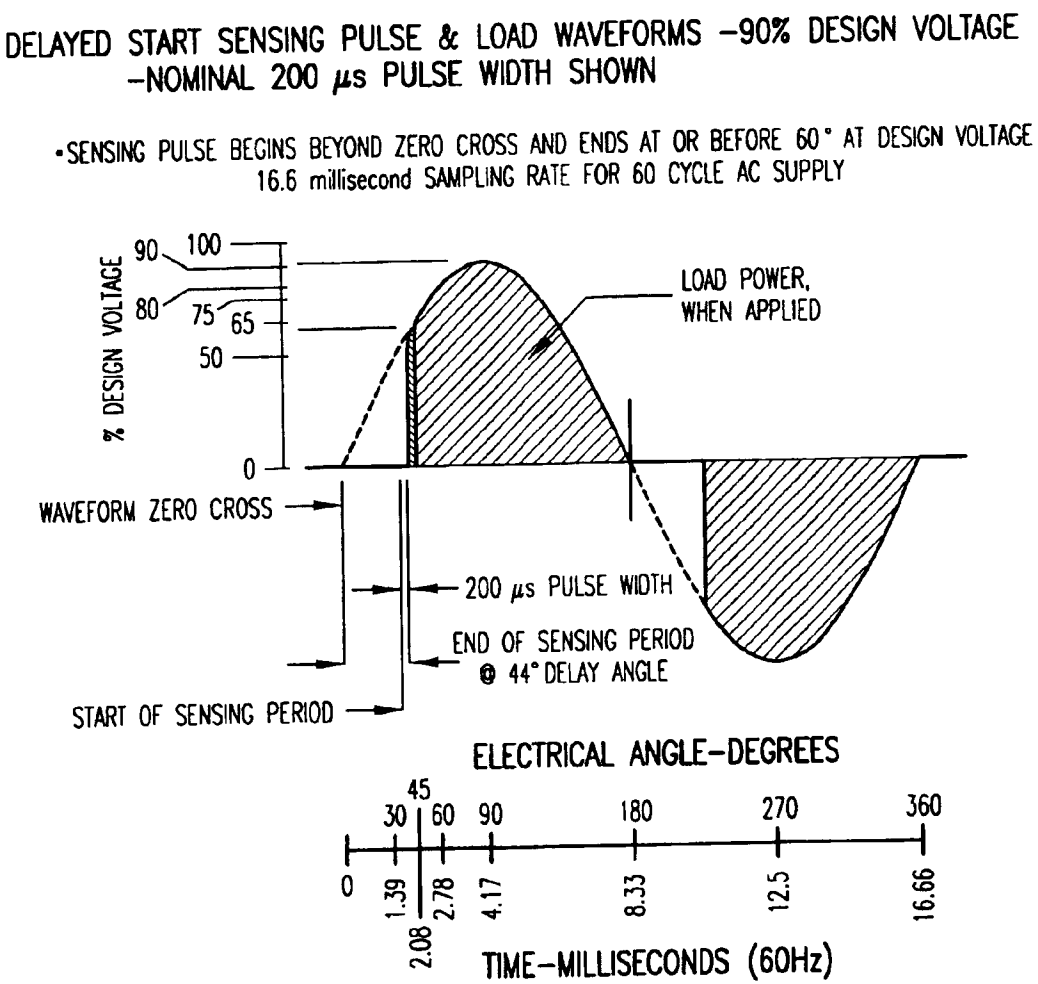
Figure 14:
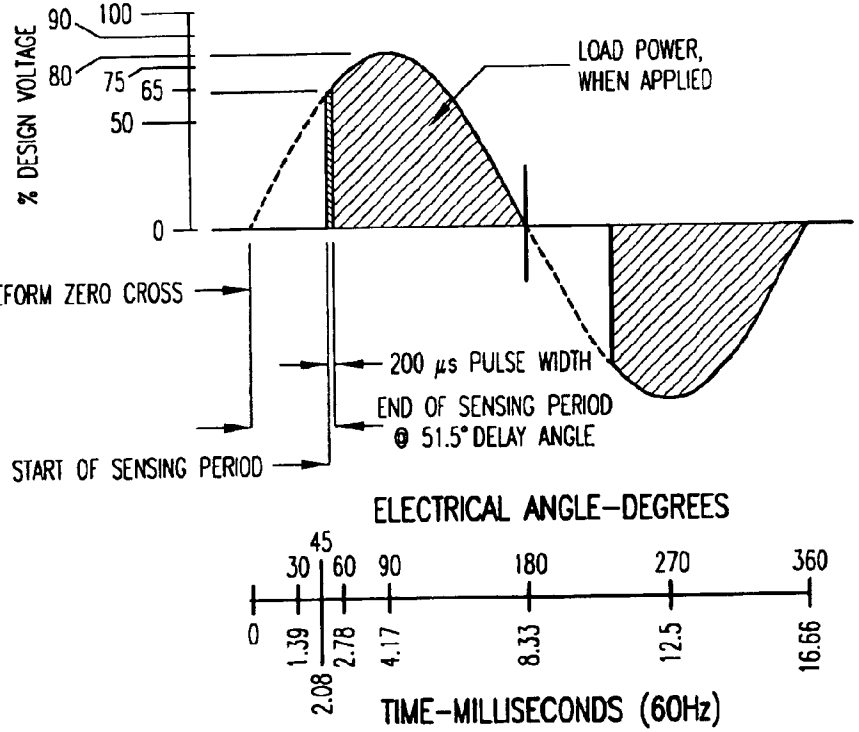
Figure 15:
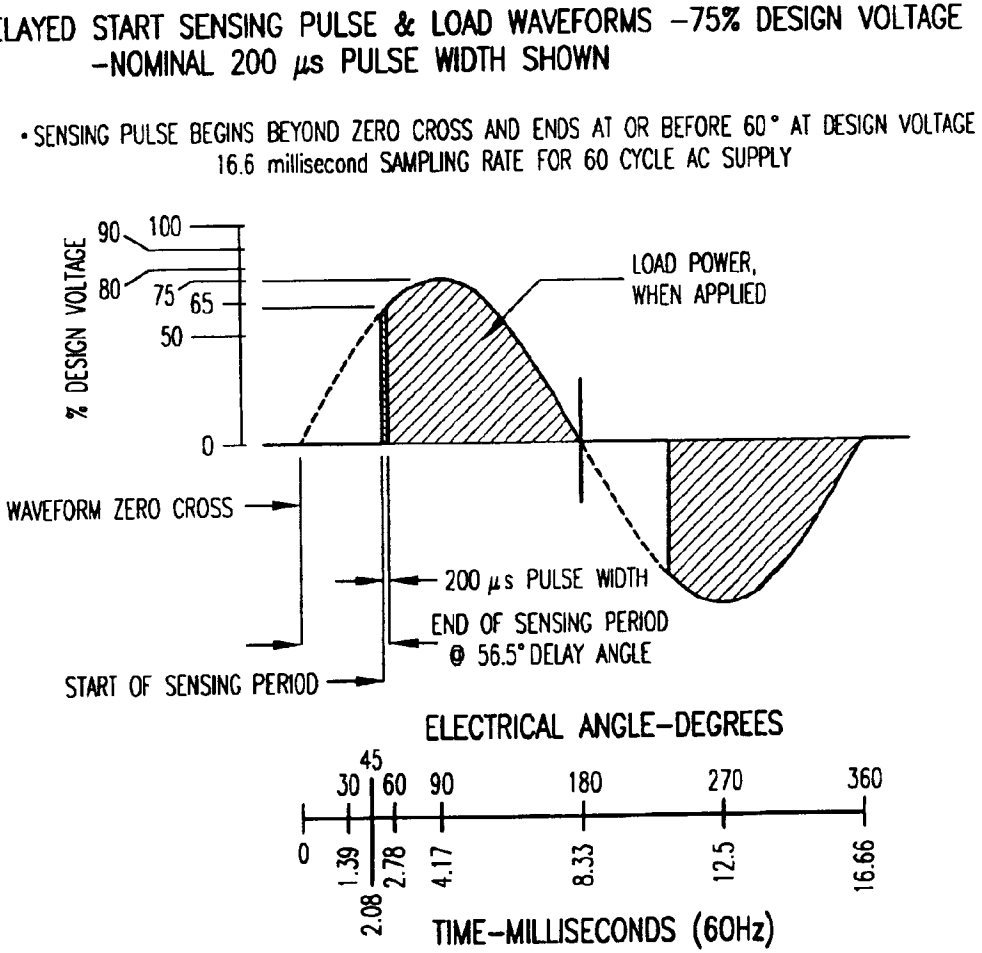

FIG. 11 shows how the delay angle must change, for various values of supply voltage, measured as a percentage of nominal design voltage. FIGS. 12–15 provide waveforms illustrating the cases represented in FIG. 11. In each of FIGS. 12–15, the delay angle, i.e. the start of the sensing pulse, is somewhat different, but the amplitude of the sensing pulse is essentially the same. Experimental tests have shown that the amplitude of the sensing pulse may vary by less than 2% even when the supply voltage decreases by as much as 30%.

The exact shape and location of the sensing pulses depends on several interrelated considerations. In general, as explained above, it is usually desirable to shorten the width or duration of the pulse, in order to reduce power dissipation. But it is also necessary that the sensing pulse have sufficient amplitude to do the job it was intended to do. Therefore, it is not practical to provide a narrow pulse which starts at or near the zero crossing point, simply because the amplitude of the pulse would be insufficient.

The positioning of the sensing pulse depends on the following three criteria. First, from the standpoint of providing sensing current, one wants the sensing pulse to start relatively late in the waveform, so that its amplitude will be as large as possible. The maximum amplitude would occur if the delay angle were 90 degrees.

Secondly, in order to insure that the amplitude of the pulses will remain relatively independent of the supply voltage, it is necessary that the pulse amplitude be less than the maximum amplitude of the supply voltage. The maximum supply voltage is a limiting voltage; the amplitude of the sensing pulses cannot be any greater. Thus, if the delay angle were as great as 90 degrees, any reduction in the supply voltage would necessarily cause a reduction in the amplitude of the sensing pulses. But if the delay angle is less than 90 degrees, the amplitude of the sensing pulses may still be kept constant despite a decrease in supply voltage, as long as that amplitude is less than or equal to the minimum peak supply voltage. Thus, this consideration makes it undesirable to make the delay angle as great as 90 degrees.

Thirdly, starting the sensing pulse later in the waveform limits the energy available to deliver to the heating element. This consideration also dictates that the pulse be started earlier in the waveform.

In designing the circuit for use with a particular application, it is preferred first to choose a turn-off point for the pulse, and then design the turn-on point such that the width of the pulse will be about 150 microseconds, for example, or whatever the desired width will be. Stated another way, one selects the position of the turn-off point, and one starts the pulse as close as possible to that point. For a given nominal line voltage, a turn-off point of about 60 degrees provides a good compromise relative to considerations discussed above.

An additional reason for beginning the sensing pulse substantially after the zero crossing point is to reduce the effect of circuit transients. Inductance in the circuit may cause circuit disturbances at the moment of zero crossing, and such effects can degrade the quality of the sensing pulse, making the circuit less stable and less accurate. Starting the sensing pulse far away from the zero crossing point avoids this problem.

On the other hand, to the extent that wider pulses are desired, for the reasons described elsewhere in this specification, such as when higher PTC materials are used, one can use the same circuit topology to create wider pulses, simply by using components having different values. Wider pulses may be desirable where it is necessary to allow time for circuit transients to settle down.

The circuits of the present invention are sufficiently versatile to produce either wide or narrow pulses. By appropriate adjustment of component values, the sensing pulses may be as wide as about 4 milliseconds, or as narrow as about 100 microseconds.

Therefore, one of the novel features of the present invention is that it permits the user to choose the starting point of the sensing pulses.

Depending on the needs of the application, the starting point could be anywhere from near the zero crossing point (in which case the pulse might need to be wider than the case in which the pulse begins later, to provide sufficient sensing current), or it could be far away from the zero crossing point, or anywhere in between. In U.S. Pat. No. 6,100,510, by contrast, there is no such flexibility; in the prior circuit, the pulses of necessity begin shortly after the zero crossing point. Thus, in one aspect, the present invention comprises the method which includes choosing a starting point of the sensing pulse, the starting point being selected from a range which extends from the zero crossing point to the maximum point on the waveform.

The improved CRC of the present invention shows that sensing pulses of very short duration are practical, when using the circuit described in U.S. Pat. No. 6,100,510. Experimental tests have shown that pulse widths as short as 150 microseconds are feasible. The principal limiting factors on pulse width appear to be system electrical inductance, and the speed of response of the circuitry. The use of such narrow pulses substantially reduces circuit dissipation, and well below the levels experienced with circuitry built only according to the teachings of the cited patent. Short sensing periods permit the use of high peak sensing current. This capability allows the circuit to be used with very low PTC heating elements.

On the other hand, in certain cases, ultra-fast switching of sensing currents may not always be necessary or desirable. Ultra-fast switching of high sensing currents can cause power line disturbances that may affect other electrical equipment in the same facility. The potential problems associated with pulses having short rise times are exacerbated as the system inductance increases. Although necessary for some applications, such as low PTC heaters, fast switched, narrow pulses should only be used when needed.

Examples of applications that do not require ultra-fast switching almost always include heaters made from medium and high PTC element materials. In these applications, longer sensing pulse duration, and pulses having leading and trailing edges that are not nearly vertical, result in better tolerance for poor power supply conditions and for high inductance in the load circuit.

Therefore, the present invention makes it easier to tailor the CRC to the specific application. The present invention can be used to generate extremely narrow sensing pulses, or it can be adjusted to make the pulses less narrow.

As noted above, the tolerance of the present invention for variations in supply voltage is excellent. The circuit of the present invention automatically corrects for such variations, and the correction occurs within one or two cycles. This feature is of particular benefit when the circuit operates a very fast-response heater under typical manufacturing plant conditions. Motor starting loads, for example, often cause instantaneous swings of 10–15% in supply voltage. The fast compensation offered by the present invention improves the stability of the process being controlled.

Although somewhat more complex than the other embodiments, the quad comparator alternative has the advantage that it is more versatile and easier to configure for specific pulse characteristics. It provides the added capability to do either 16.6 millisecond or 8.3 millisecond sampling rates. Sampling rates of 8.3 milliseconds are useful mostly for heating systems having extremely low thermal inertia, and which have practically no inductance and very short time constants.

The invention can be modified in various ways, as will be apparent to the reader skilled in the art. For example, the electrical behavior of any device or network used at the position of Z3 has a major effect on the performance of the circuit, and devices other than zener diodes and SIDACs, such as SCRs or the like, may be substituted in place of either of these components. The invention is not limited to analog components, but could be implemented by digital means, or by digitally-assisted means. Also, the invention need not generate pulses only at the beginning of positive half-cycles. By appropriate changes of components, one could modify the circuit to generate sensing pulses within negative half-cycles. These and other similar modifications should be deemed within the spirit and scope of the following claims.

What is claimed is:

1. In a control device including a combined temperature sensor and heating unit, the control device comprising a bridge circuit having a plurality of arms, the bridge circuit being connected to an AC supply voltage, one arm of the bridge circuit comprising a heating element, means for directing a sensing current through the heating element, means for detecting a condition wherein the bridge circuit is in an essentially electrically balanced state, and means for directing a heating current through the heating element in response to an essentially electrically unbalanced condition, wherein the control device comprises means for repeatedly interrupting a flow of the sensing current to the heating element, the improvement comprising means for selecting start and stop points for the sensing current, and for causing sensing current to flow only between said start and stop points, wherein said start points occur substantially after a zero crossing point of said AC supply voltage.

2. The improvement of claim 1, wherein the selecting means comprises a zener diode.

3. The improvement of claim 1, wherein the selecting means comprises a first zener diode for determining a start point for the sensing current, and a second zener diode for determining a stop point for the sensing current.

4. The improvement of claim 1, wherein the selecting means comprises a quad comparator.

5. The improvement of claim 1, wherein the selecting means includes a SIDAC.

6. The improvement of claim 1, wherein the selecting means comprises a SIDAC for determining a start point for the sensing current, and a zener diode for determining a stop point for the sensing current.

7. The improvement of claim 1, wherein the selecting means includes a switch and an optocoupler, the optocoupler being connected to receive a supply voltage, the optocoupler being connected to an RC network, the optocoupler being connected to operate the switch so as to generate pulses of sensing current.

8. The improvement of claim 1, wherein the selecting means includes means for generating a sensing pulse having an amplitude which is essentially independent of said AC supply voltage.

9. A current reduction circuit for generating sensing pulses and for directing said sensing pulses to a heating element comprising an arm of a bridge circuit, the current reduction circuit comprising:

a) an electronic switch connected to a heating element in a bridge, the electronic switch comprising means for creating sensing pulses and for directing said sensing pulses to the heating element, and b) means for activating said switch at selected times and means for deactivating said switch at selected times, wherein the activating and deactivating means cause the switch to generate sensing pulses having a desired duration, wherein the activating means activates said switch at a start point which is displaced from a beginning of a half-cycle of a supply voltage, wherein the activating means comprises a SIDAC.

10. The improvement of claim 8, wherein each sensing pulse has a duration which is less than about 200 microseconds.

11. The improvement of claim 10, wherein the sensing pulses have a duration which is not greater than about 150 microseconds.

12. The improvement of claim 8, wherein each sensing pulse has a duration in a range between about 100 microseconds and about 4 milliseconds.

13. A current reduction circuit for generating sensing pulses and for directing said sensing pulses to a heating element comprising an arm of a bridge circuit, the current reduction circuit comprising:

a) an electronic switch connected to a heating element in a bridge, the electronic switch comprising means for creating sensing pulses and for directing said sensing pulses to the heating element, and b) means for activating said switch at selected times and means for deactivating said switch at selected times, wherein the activating and deactivating means cause the switch to generate sensing pulses having a desired duration.

wherein the activating means activates said switch at a start point which is displaced from a beginning of a half-cycle of a supply voltage, wherein the activating means comprises a SIDAC for determining a start point for each of the sensing pulses, and wherein the deactivating means comprises a zener diode for determining a stop point for each of the sensing pulses.

14. A current reduction circuit for generating sensing pulses and for directing said sensing pulses to a heating element comprising an arm of a bridge circuit, the current reduction circuit comprising:

a) an electronic switch connected to a heating element in a bridge, the electronic switch comprising means for creating sensing pulses and for directing said sensing pulses to the heating element, and b) means for activating said switch at selected times and means for deactivating said switch at selected times, wherein the activating and deactivating means cause the switch to generate sensing pulses having a desired duration, wherein the activating means activates said switch at a start point which is substantially displaced from a beginning of a half-cycle of a supply voltage.

15. The current reduction circuit of claim 14, wherein the activating and deactivating means both include a zener diode.

16. The current reduction circuit of claim 14, wherein the activating means comprises a first zener diode which controls a start point for each of said sensing pulses, and wherein the deactivating means comprises a second zener diode which controls a stop point for each of said sensing pulses.

17. The current reduction circuit of claim 14, wherein the activating and deactivating means include a quad comparator.

18. The current reduction circuit of claim 14, wherein the activating means comprises a SIDAC.

19. The current reduction circuit of claim 14, wherein the activating means comprises a SIDAC for determining a start point for each of the sensing pulses, and wherein the deactivating means comprises a zener diode for determining a stop point for each of the sensing pulses.

20. The current reduction circuit of claim 14, wherein the switch is operated by an optocoupler, the optocoupler being connected to receive said supply voltage, the optocoupler being connected to an RC network.

21. The current reduction circuit of claim 14, wherein the activating and deactivating means comprise means for generating a sensing pulse having an amplitude which is essentially independent of the supply voltage.

22. The current reduction circuit of claim 14, wherein each sensing pulse has a duration which is less than about 200 microseconds.

23. The current reduction circuit of claim 14, wherein each sensing pulse has a duration which is not greater than about 150 microseconds.

24. The current reduction circuit of claim 14, wherein each sensing pulse has a duration in a range between about 100 microseconds and about 4 milliseconds.

25. A method of operating a control device including a combined temperature sensor and heating unit, the control device comprising a bridge circuit having a plurality of arms, one arm of the bridge circuit comprising a heating element, means for directing a sensing current through the heating element, means for detecting a condition wherein the bridge circuit is in an essentially electrically balanced state, and means for directing a heating current through the heating element in response to an electrically unbalanced condition, the method comprising the step of repeatedly interrupting a flow of the sensing current to the heating element, wherein the sensing current is provided as a series of pulses, wherein each pulse begins substantially after a beginning of a half-cycle of a supply voltage.

26. The method of claim 25, including determining a desired turn-off point for each pulse, the turn-off point being selected to provide a pulse amplitude sufficiently high to accomplish sensing, but less than a maximum amplitude of the supply voltage.

27. The method of claim 26, including selecting a turn-on point for each pulse, the turn-on point being selected to be sufficiently close to the turn-off point so as to minimize current dissipation while avoiding inductive effects.

28. The method of claim 27, wherein the turn-on point is selected to be less than about 200 microseconds before the turn-off point.

29. The method of claim 28, wherein the turn-on point is selected to be less than about 150 microseconds before the turn-off point.

30. The method of claim 27, wherein the turn-off point is selected to be about 60 degrees or less at design supply voltage.

31. A method of operating a control device including a combined temperature sensor and heating unit, the control device comprising a bridge circuit having a plurality of arms, one arm of the bridge circuit comprising a heating element, means for directing a sensing current through the heating element, means for detecting a condition wherein the bridge circuit is In an essentially electrically balanced state, and means for directing a heating current through the heating element in response to an electrically unbalanced condition, the method comprising the step of repeatedly interrupting a flow of the sensing current to the heating element, wherein the sensing current is provided as a series of pulses, and wherein the method also includes selecting a starting point for each pulse, wherein the starting point is selected from a range that begins substantially after a zero-crossing point of a supply voltage and ends in a vicinity of a maximum point of the supply voltage.

32. The method of claim 31, including determining a desired turn-off point for each pulse, the turn-off point being selected to provide a pulse amplitude sufficiently high to accomplish sensing, but less than a maximum amplitude of the supply voltage.

33. The method of claim 32, wherein the starting point for each pulse is selected to be sufficiently close to the turn-off point so as to minimize current dissipation while avoiding inductive effects.

34. In a control device including a combined temperature sensor and heating unit, the control device comprising a bridge circuit having a plurality of arms, one arm of the bridge circuit comprising a heating element, means for directing a sensing current through the heating element, means for detecting a condition wherein the bridge circuit is in an essentially electrically balanced state, and means for directing a heating current through the heating element in response to an essentially electrically unbalanced condition, wherein the control device comprises means for repeatedly interrupting a flow of the sensing current to the heating element, the improvement comprising means for selecting start and stop points for the sensing current, and for causing sensing current to flow only between said start and stop points, wherein the selecting means includes a SIDAC.

35. In a control device including a combined temperature sensor and heating unit, the control device comprising a bridge circuit having a plurality of arms, one arm of the bridge circuit comprising a heating element, means for directing a sensing current through the heating element, means for detecting a condition wherein the bridge circuit is in an essentially electrically balanced state, and means for directing a heating current through the heating element in response to an essentially electrically unbalanced condition, wherein the control device comprises means for repeatedly interrupting a flow of the sensing current to the heating element, the improvement comprising means for selecting start and stop points for the sensing current, and for causing sensing current to flaw only between said start and stop points, wherein the selecting means comprises a SIDAC for determining a start point for the sensing current, and a zener diode for determining a stop point for the sensing current.

* * * * *